US005469024A

United States Patent [19]

Kirshner et al.

[11] Patent Number: 5,469,024

[45] Date of Patent: Nov. 21, 1995

[54] LEAKY WALL FILTER FOR USE IN EXTENDED INTERACTION KLYSTRON

[75] Inventors: Mark F. Kirshner, Redwood City; Robert S. Symons, Los Altos, both of Calif.

[73] Assignee: Litton Systems, Inc., Beverly Hills, Calif.

[21] Appl. No.: 185,485

[22] Filed: Jan. 21, 1994

[51] Int. Cl.[6] ..... H01J 23/40

[52] U.S. Cl. ..... 315/5.39; 315/5.51; 315/39; 333/211; 333/251

[58] Field of Search ..... 315/5.39, 5.51, 315/39; 333/251, 211

[56] References Cited

U.S. PATENT DOCUMENTS

| | | | |
|---|---|---|---|
| 2,970,242 | 1/1961 | Jepsen | 315/5.39 |
| 4,284,922 | 8/1981 | Perring et al. | 315/5.39 |
| 4,799,031 | 1/1989 | Lang et al. | 333/22 F X |
| 4,931,695 | 6/1990 | Symons | 315/5.39 |
| 5,187,408 | 2/1993 | Jödicke et al. | 333/22 F X |

FOREIGN PATENT DOCUMENTS

| | | |
|---|---|---|
| 1004976 | 9/1965 | United Kingdom . |
| 1199341 | 7/1970 | United Kingdom . |
| 2098390 | 11/1982 | United Kingdom . |

OTHER PUBLICATIONS

"Build Absorptive All–Harmonic Waveguide Filters", by Richard Z. Gerlack, Microwaves & RF, Apr. 1993 (5 pages).

*Primary Examiner*—Benny T. Lee

*Attorney, Agent, or Firm*—Graham & James

[57] ABSTRACT

A leaky wall filter for use in an EIK comprises a plurality of guidelets intersecting perpendicularly with a wall of an output waveguide of the EIK. The guidelets would propagate $2\pi$ mode oscillation frequencies from the EIK out of the output waveguide. A load matched to the $2\pi$ mode disposed at the end of the guidelets provides termination for the $2\pi$ mode oscillation frequencies and prevents the initiation of oscillation. The load comprises a plenum disposed at an end of the guidelets opposite to the output waveguide, a window having a first surface within the plenum, and a water load provided at a second surface of the window. The $2\pi$ mode oscillation frequencies propagating through the guidelets are impedance matched by the window and coupled into the water load for termination. Since a portion of the operating frequency power also leaks through the guidelets into the plenum due to insertion loss, this combined RF power also couples into the water load and is converted into thermal energy. A fluid circulation system is provided to remove the thermal energy from the water load. The window is comprised of alumina ceramic which effectively couples the $2\pi$ mode oscillation frequencies and RF power into the water load.

6 Claims, 4 Drawing Sheets

2
2
30
34
32
24
42
38
22
18
16
10
14
12

16
4
4
34
36
10
14

FIG. 3
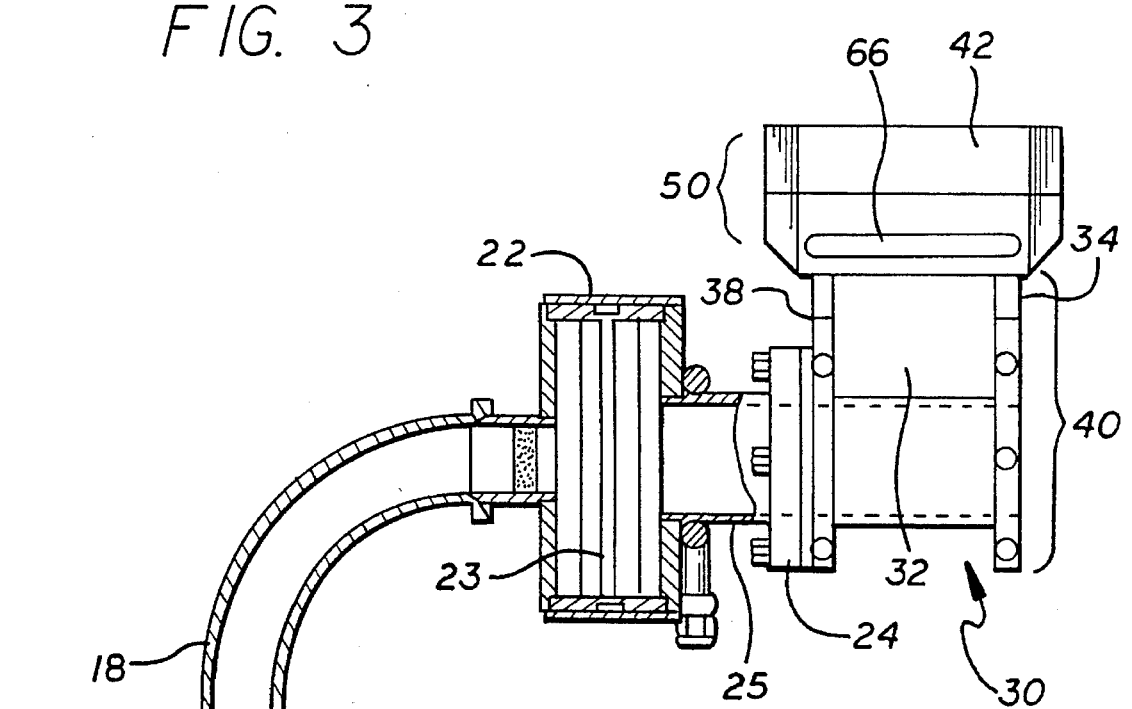
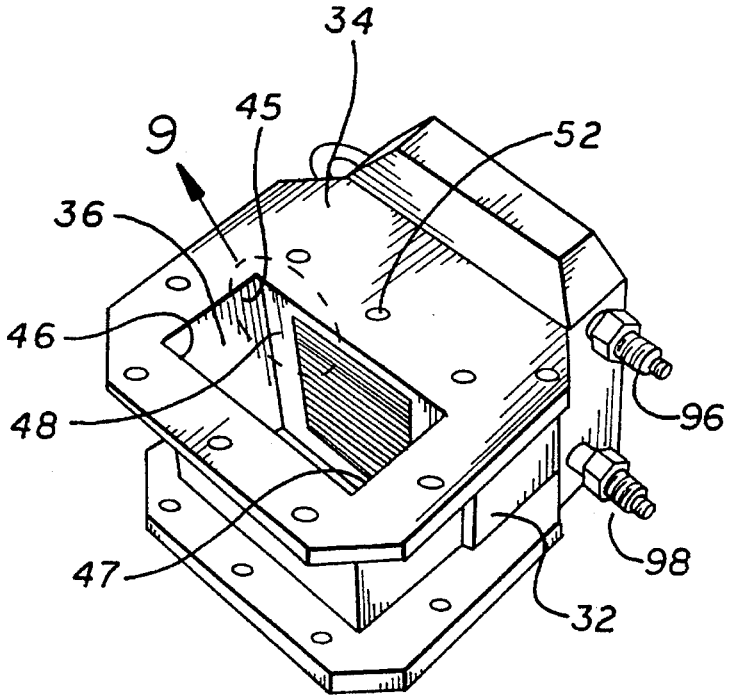
FIG. 8

LEAKY WALL FILTER FOR USE IN EXTENDED INTERACTION KLYSTRON

BACKGROUND OF THE INVENTION

1. Field of the Invention

The present invention relates to output waveguides for transmitting electromagnetic energy from a microwave amplification device, and more particularly, to a novel leaky wall filter for suppressing the 2π mode oscillation within an output waveguide of an extended interaction klystron.

2. Description of Related Art

Linear beam tubes are used in sophisticated communication and radar systems which require amplification of an RF or microwave electromagnetic signal. A conventional klystron is an example of a linear beam microwave amplifier. A klystron comprises a number of cavities divided into essentially three sections: an input section, a buncher section, and an output section. An electron beam is sent through the klystron, and is velocity modulated by an RF electromagnetic input signal that is provided to the input section. In the buncher section, those electrons that have had their velocity increased gradually overtake the slower electrons, resulting in electron bunching. The traveling electron bunches represent an RF current in the electron beam. The RF current induces electromagnetic energy into the output section of the klystron as the bunched beam passes through the output cavity, and the electromagnetic energy is extracted from the klystron at the output section. An output waveguide channels the electromagnetic energy to an output device, such as an antenna.

The development of high powered klystron amplifiers which operate at a peak power level higher in relation to pulse length and frequency than that of conventional klystrons has resulted in beam voltage levels generally higher than that previously achieved. To avoid RF breakdown in the output section due to the high beam voltage, multi-cavity output circuits were developed. The multi-cavity output circuits, known as extended interaction output circuits (EIOC), have the advantage that a higher level of impedance across a greater bandwidth can be achieved. The higher impedance enables better matching with the electron beam, leading to greater efficiency of operation. An EIOC used to produce high power microwave energy with large instantaneous bandwidth is referred to as an extended interaction klystron (EIK), and can be used to produce power over bandwidths in excess of ten percent. An example of a high performance EIOC is disclosed in U.S. Pat. No. 4,931,695, to Symons.

A significant drawback of the EIK results from the multi-cavity configuration of the EIOC. If the EIK is utilized in a system having a poor impedance match with an output device at a frequency directly above the operating band of the EIK, instability in the form of unwanted oscillations can occur. For example, the use of a rotary joint coupled to the output waveguide can present a poor impedance match above the operating band. A rotary joint enables the rotation of an antenna so that RF energy can be emitted throughout a circular range of motion. Rotary joints are optimally designed for a good impedance match at the operating band of frequencies of the EIK. It is generally difficult, however, to maintain the quality of the impedance match over a broad band of frequencies outside the operating band.

The cause of the unwanted oscillations is traceable to the 2π mode of the EIOC. The 2π mode is a resonant condition occurring when the gap voltages in each of the output cavities of the EIOC are exactly in phase. Under poor impedance match conditions, power can "feedback" from the second or downstream output cavity back to the first cavity through inductive coupling slots that couple the cavities. The feedback power can modulate the electron beam which, in turn, delivers the energy back to the subsequent gap or gaps in phase. Unless the 2π mode frequencies encounter a good impedance match, the cycle would repeat and build up to the point of oscillation. In some extreme cases, 2π mode oscillation can result in catastrophic damage to the EIK, the rotary joint or other output devices coupled to the EIK. Since the 2π mode frequencies may occur beyond the operating band of the EIK, even EIKs having a good impedance match throughout the operating band may not be immune to the undesirable 2π mode oscillation.

In other types of microwave devices, such as coupled cavity traveling wave tubes (TWTs), this problem has been successfully dealt with through the use of lossy dielectric resonators coupled to the sides of the cavity walls. Because a device comprised of many cavities will have a well defined 2π mode frequency, the dielectric resonators may have a high value of quality factor (Q) in order to achieve an adequate degree of attenuation of the 2π mode oscillation over a very narrow range of frequencies and must be trimmed to the precise frequency of the 2π mode.

In a typical EIK, however, the range of frequencies of the 2π mode is too broad to be successfully damped by the relatively narrow band dielectric resonators. The output circuit of the EIK is equipped with tuning adjustments in order to optimize power and bandwidth. In the course of this tuning, the various resonances within the EIOC, including the 2π mode, will change frequency. This renders the use of internal, high-Q, fixed frequency dielectric resonators impractical for most EIK applications.

Accordingly, it would be desirable to provide an apparatus for use with an EIK that suppresses the 2π mode oscillation over a relatively broad frequency range. It would be further desirable to provide an apparatus having the above characteristics, while being relatively simple to design and cost effective to fabricate.

SUMMARY OF THE INVENTION

In accordance with the teachings of this invention, a leaky wall filter for use in an EIK is provided. The leaky wall filter comprises a plurality of guidelets intersecting perpendicularly with a wall of an output waveguide of the EIK. The guidelets would propagate 2π mode oscillation frequencies from the EIK out of the output waveguide. A load matched to the 2π mode oscillation frequencies disposed at the end of the guidelets provides termination for the 2π mode oscillation frequencies and prevents the initiation of oscillation.

The load comprises a plenum disposed at an end of the guidelets opposite to the output waveguide, a window having a first surface within the plenum, and a water load provided at a second surface of the window. The 2π mode oscillation frequencies propagating through the guidelets are impedance matched by the window and coupled into the water load for termination. Since a portion of the operating frequency power also leaks through the guidelets into the plenum due to insertion loss, this combined RF power also couples into the water load and is converted into thermal energy. A fluid circulation system is provided to remove the thermal energy from the water load. The window is comprised of alumina ceramic which effectively couples the 2π mode oscillation frequencies and RF power into the water load.

More specifically, the guidelets are distributed along the wall of the output waveguide over a distance equivalent to half of a guide wavelength such that regardless of the phase of reflection originating beyond the leaky wall filter, a maximum voltage of the RF energy will fall within one of the guidelets and be propagated to the absorber. The width of the guidelets is determined such that the RF power is cut off slightly above the upper edge of the operating band of the EIK. The height of the guidelets is selected to be as small as possible to avoid creating a substantial in band frequency mismatch while maintaining sufficient clearance to preclude the possibility of arcing due to the propagating RF power. The depth of the guidelets is approximately half of a guide wavelength.

A more complete understanding of the leaky wall filter for use in an extended interaction klystron will be afforded to those skilled in the art, as well as a realization of additional advantages and objects thereof, by consideration of the following detailed description of the preferred embodiment. Reference will be made to the appended sheets of drawings which will be first described briefly.

BRIEF DESCRIPTION OF THE DRAWINGS

FIG. 3 is a sectional side view of the leaky wall filter;

FIG. 8 is a perspective view of the leaky wall filter; and

DETAILED DESCRIPTION OF THE PREFERRED EMBODIMENT

Figures 1, 2:
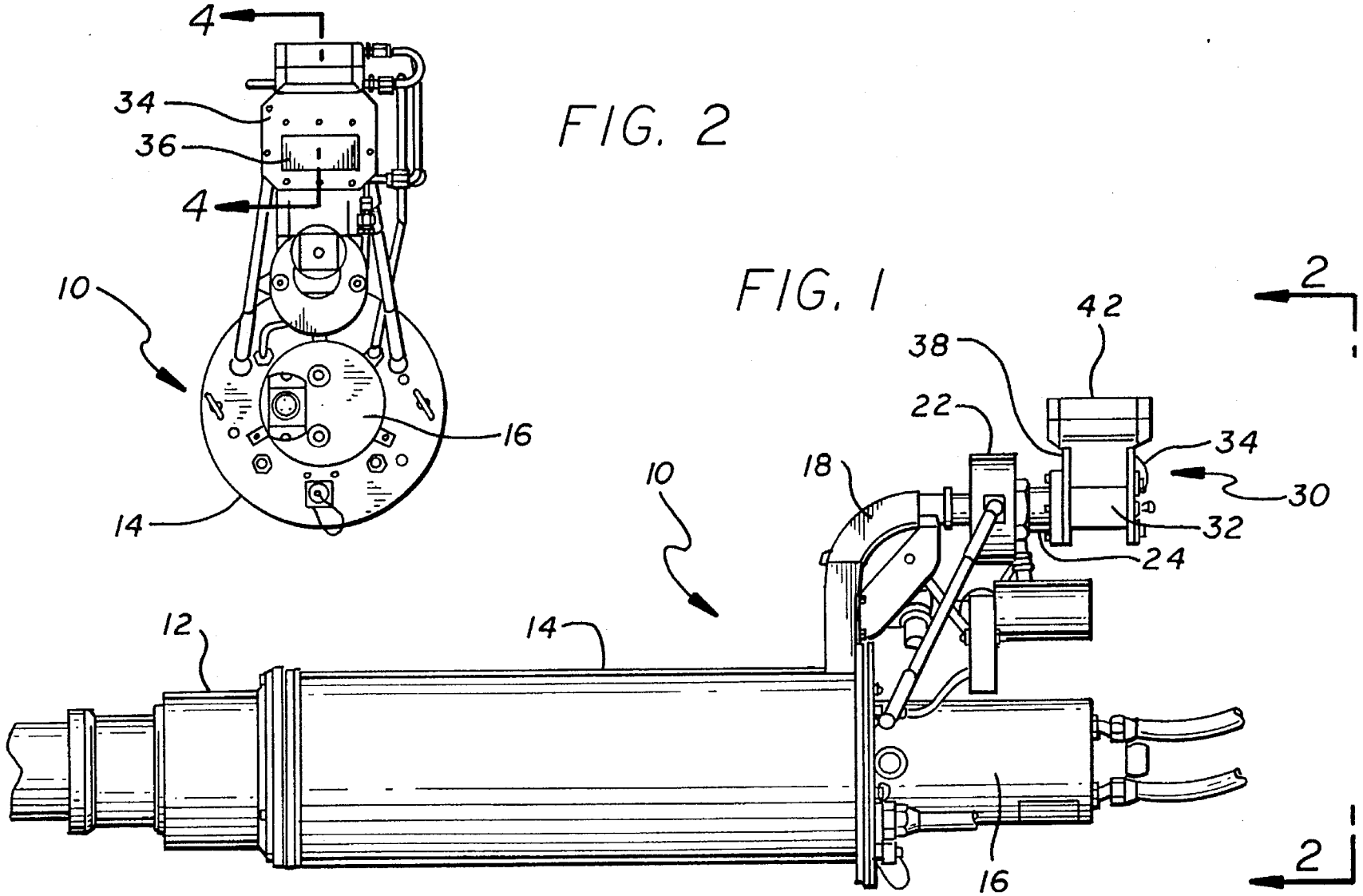
FIG. 1 is a side view of an EIK utilizing a leaky wall filter of the present invention.
FIG. 2 is an end view of the EIK of FIG. 1.

The present invention provides a leaky wall filter for an EIK that suppresses the $2\pi$ oscillation mode over a relatively broad frequency range. Moreover, the leaky wall filter has generally simple construction and occupies a relatively small amount of volume with respect to the EIK, enabling the leaky wall filter to be advantageously utilized within a design envelope of existing microwave amplification systems. In the description that follows, identical reference numerals are used to describe the same element or elements that appear in the various figures.

Referring first to FIGS. 1 through 3, an EIK 10 having a leaky wall filter 30 is illustrated. The EIK 10 comprises a linear beam tube section 14 containing an EIOC (see FIG. 1). Output cavities 6 and 8 of the EIOC are illustrated in FIG. 3. As illustrated in FIG. 1, an electron gun 12 is disposed at a first end of the tube section 14, and a collector 16 is disposed at an opposite end thereof. As known in the art, the electron gun 12 projects a beam of electrons through the tube section 14. Energy in the beam is given up to an RF signal traveling through the EIOC. The spent electrons of the beam exit the tube section 14 and are collected within the collector 16.

The RF power produced within the EIOC is removed from the tube section 14 through an output waveguide 18 that couples the energy to a window 22. The window 22 includes a vacuum barrier 23 that provides a seal between the vacuum environment existing within the EIOC, and the non-vacuum environment external to the EIOC (see FIG. 3). As known in the art, the barrier 23 is formed of an RF transparent material. Downstream from the window 22, a mating flange 24 is provided to enable coupling of the RF energy from the EIK into the leaky wall filter 30, which will now be described in greater detail with respect to FIGS. 3 through 9.

In the present invention, the leaky wall filter 30 provides two essential functions. First, the leaky wall filter provides a matched load for termination of $2\pi$ mode oscillation frequencies produced by the EIK. Second, the leaky wall filter provides for dissipation of thermal energy resulting from a portion of the operating frequency power which also leaks into the leaky wall filter due to insertion loss. As will be set forth below, practical constraints in construction of the filter are such that the RF energy due to insertion loss can not be completely eliminated, requiring a mechanism for dissipating heat resulting from the RF energy as well as the $2\pi$ mode oscillation frequencies.

The leaky wall filter 30 is provided in a substantially integral housing 32 that combines with a water jacket 42. The leaky wall filter 30 generally includes a waveguide portion 40 and a load portion 50, as illustrated in FIG. 3. The waveguide portion 40 comprises a substantially rectangular output waveguide 36 (see FIG, 8) for conduction of RF power passing through the window 22. The output waveguide 36 has a lower surface 46, an upper surface 48, a left surface 45, and a right surface 47. The rectangular shape of the output waveguide 36 is intended to match uniformly with the shape of the waveguide portion 25 exiting the window 22 (see FIG. 3), so as to avoid any unintended perturbations or reflections of the propagating RF power. It is anticipated that the housing 32 will be comprised of an electrically conductive material, such as aluminum, and may be formed by use of conventional machining processes.

As best illustrated in FIG. 3, on either side of the housing 32, mating flanges 34, 38 are provided, respectively. Mating flange 38 comprises the input side of the waveguide 36, and mating flange 34 comprises the output side of the waveguide. The mating flanges 34, 38 comprise a generally flat surface that is conducive to engagement with an opposing flange, such as flange 24 of the waveguide 25. A similar flange of an output device (not shown), such an antenna, waveguide, or rotary joint, is intended to engage the flange 38. A plurality of bolt holes 52 are provided on each of flanges 34, 38 for joining the leaky wall filter 30 with opposing flanges. As known in the art, additional sealing material or techniques, such as the use of gaskets, may be disposed between the opposing flange portions to minimize RF energy leakage from the waveguide 36.

Figure 9:
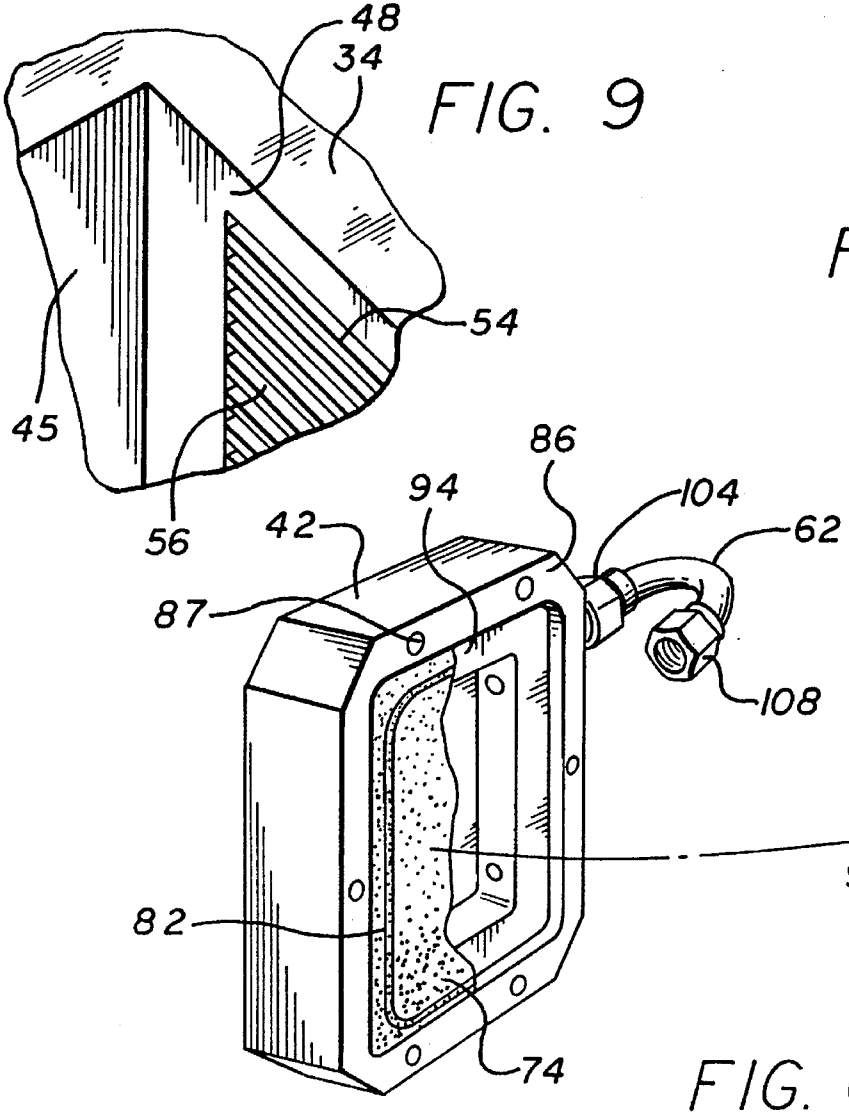
FIG. 9 is an enlarged view of the guidelets of the leaky wall filter of FIG. 8.

As illustrated in FIGS. 8 and 9, a plurality of guidelets 54 are substantially centered in the upper surface 48. Each of the guidelets 54 comprise individual waveguides intersecting perpendicularly with the upper surface 48 of the waveguide 36. The guidelets 54 comprise spaces formed between a plurality of substantially parallel plates 56 disposed in a generally rectangular space provided within the housing 32. As will be described in more detail below, the spacing, width, and depth of the guidelets 54 are critical to determining the band of frequencies to be suppressed by the leaky wall filter 30.

Figure 6:
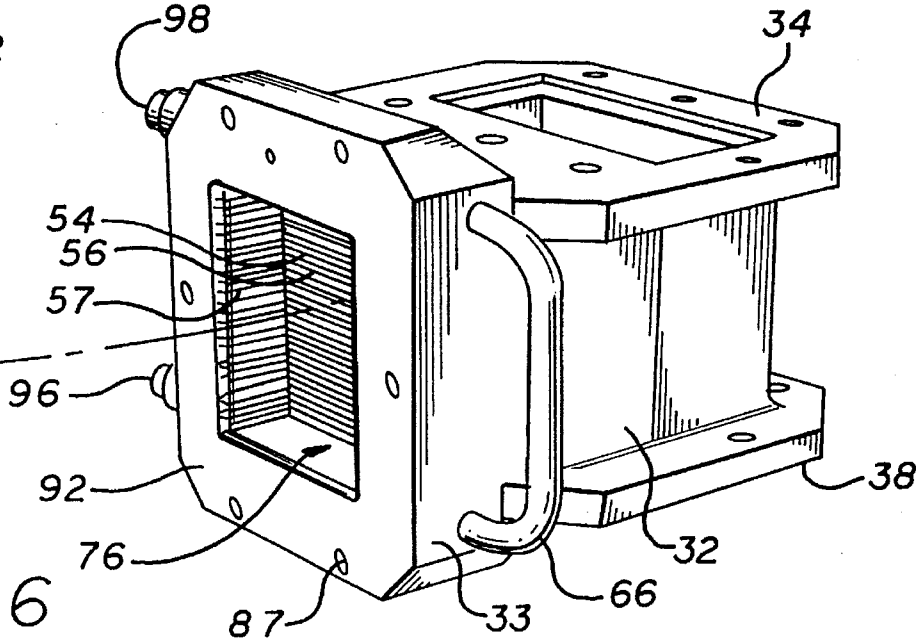
FIG. 6 is an exploded perspective view of the leaky wall filter.

In an embodiment of the present invention, the individual plates 56 engage individual slots 57 provided in the housing 32, best illustrated in FIG. 6. The plates 56 can slide into the individual slots 57, and be permanently held in place by conventional joining techniques, such as brazing. It is anticipated that the plates be comprised of an electrically conductive material, such as aluminum. After brazing the plates 56 in place within the respective slots 57, any burrs, deformations or protrusions of the brazing material must be removed to ensure unimpeded RF current conduction and avoid arcing. Moreover, the ends of the plates 56 may be somewhat rounded to further prevent arcing.

The end of the guidelets 54 opposite the waveguide 36 terminates in the load section 50 (see FIG. 3), which comprises a plenum, a window, and a water load. As illustrated in FIG. 6, the end portion 33 of the housing 32 extends farther than the plates 56, providing the plenum 76 at the end of the guidelets 54. The plenum 76 serves to combine the RF energy that has propagated through each of guidelets 54. The end portion 33 of the housing 32 has a mating surface 92 that engages an associated mating surface 86 of the water jacket 42, which fully encloses the plenum 76. Both the water jacket 42 and the end portion 33 of the housing 32 have a plurality of bolt holes 87 to enable attachment of the two structural elements together.

Figure 5:
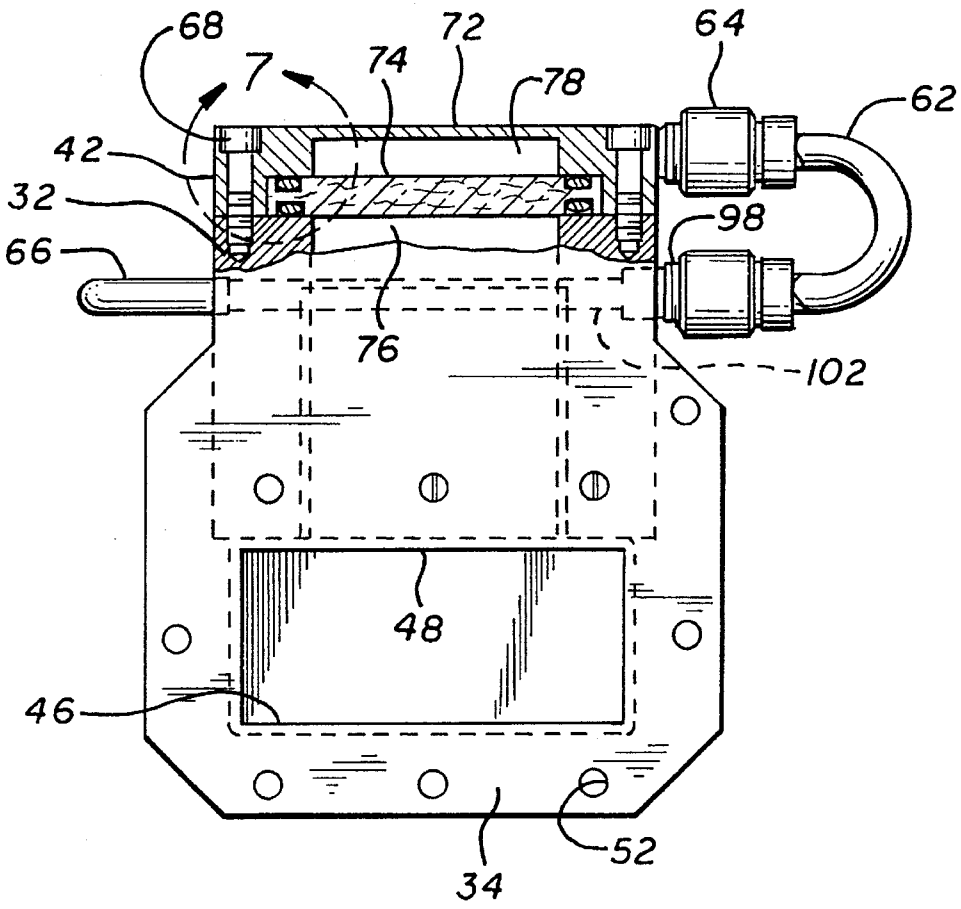
FIG. 5 is a partially cutaway end view of the leaky wall filter illustrating the load.
Figure 4:
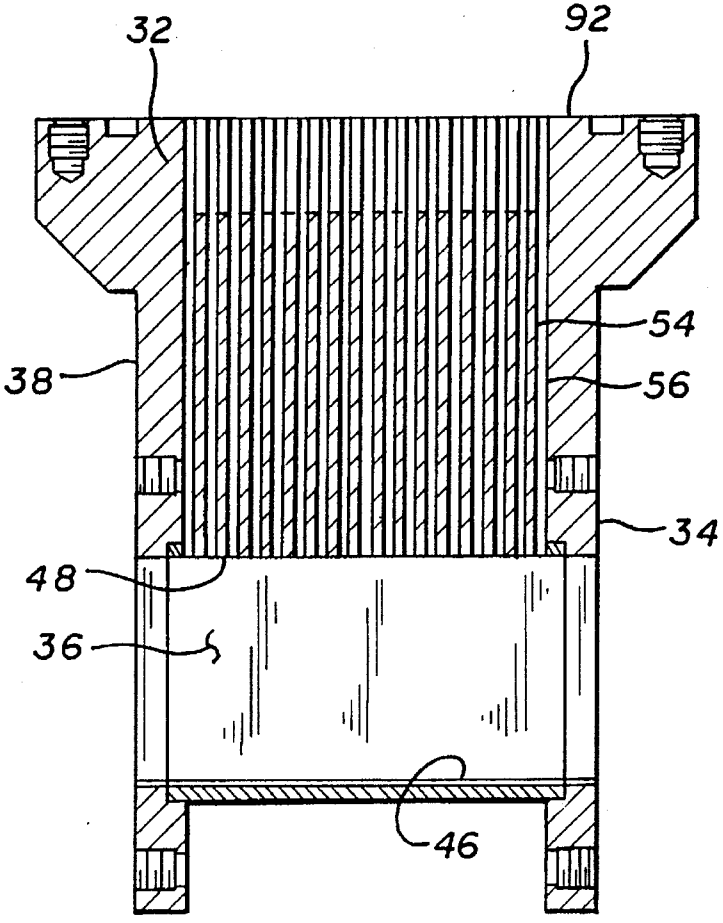
FIG. 4 is a sectional side view of the leaky wall filter as taken through the section 4—4 of FIG. 2.

As illustrated in FIG. 5, the $2\pi$ mode oscillation frequencies and RF energy that have propagated through the guidelets 54 to the plenum 76 passes through the window 74. The window 74 forms a surface of the plenum 76 facing the end of the guidelets 54. The window 74 is formed of a low loss dielectric material, such as alumina ceramic, having a thickness of one quarter of a guide wavelength. The window 74 serves to couple the $2\pi$ mode oscillation frequencies and RF energy into a water load 78 disposed on the opposite side of the window 74 from the guidelets 54. Within the water load 78, the $2\pi$ mode oscillation frequencies and RF energy is terminated, preventing its reflection back through the guidelets 54. The window 74 is generally rectangular in shape and fits within a similarly shaped slot 94 (see FIG. 6) disposed below the mating surface 86 of the water jacket 42.

Figure 7:
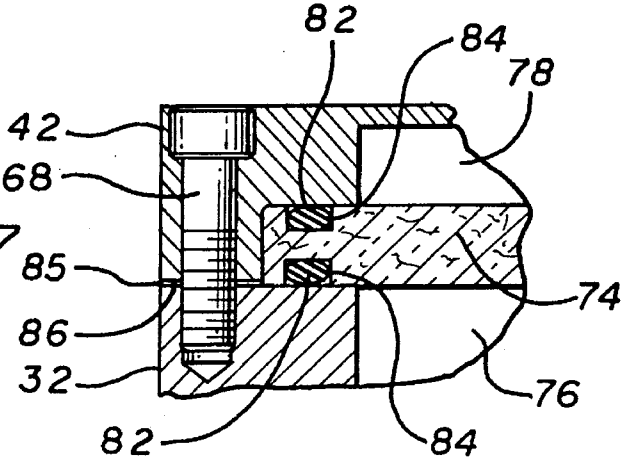
FIG. 7 is an enlarged view of the window disposed within the leaky wall filter of FIG. 5.

In an embodiment of the present invention, the window 74 has a groove 84 on both its front and back surfaces generally following the outer perimeter of the window (see FIG. 7). An O-ring 82 is disposed in both the front and rear grooves 84, permitting a seal upon engagement with the mating surface 92 of the housing 32, as illustrated in FIG. 7. To ensure that the window 74 forms an adequate seal with the plenum 76, a gap 85 is provided between the water jacket 42 and the housing 32. Upon attachment of the water jacket 42 to the housing 32, such as by use of bolts 68, the O-rings 82 generally compress to form a seal. Similarly, the O-ring disposed in the rear groove provides a seal between the window 74 and the water jacket 42, preventing leakage of fluid from the water jacket 42 into the plenum 76.

Placement of the grooves 84 containing the O-rings on the window 74 surface, rather than on either the housing 32 or the water jacket 42, is necessary to proper operation of the leaky wall filter 30. Grooves in the electrically conductive elements would promote arcing due to the RF current flowing across the surface of the elements. Such arcing would burn the O-rings, and ultimately destroy the integrity of the seals. By disposing the O-rings in grooves 84 on the window 74, the arcing problem is effectively avoided.

In operation, the $2\pi$ mode oscillation frequencies propagating through the waveguide 36 enter the guidelets 54 (see FIG. 8), and see a matched load thereby preventing the onset of oscillation. The guidelets 54 are distributed over a distance along the output waveguide equivalent to half of a guide wavelength for the $2\pi$ mode oscillation frequencies such that regardless of the phase of reflection originating beyond the leaky wall filter 30, a maximum voltage of the RF energy will fall within one of the guidelets. A guide wavelength is dependant on the particular geometry of the waveguide, and may be somewhat greater than the free space wavelength for a given frequency.

The width of the guidelets 54 is determined such that the RF power is cut off slightly above the upper edge of the operating band of the EIK. The cut off frequency comprises the frequency below which no propagation through the guidelets 54 occurs. It is desirable that the cut off frequency occur as close as possible to the upper limit of the operating band for the EIK. Accordingly, the width of the guidelets is approximately half of a wavelength at cut off frequency. In practice, however, the width should be slightly less than half of a wavelength, since infinite depth of the guidelets is not practical. The depth of the guidelets 54 in the direction of the plenum 76 can be approximately half of a guide wavelength. The height of the guidelets (or spacing between guidelets) is selected to be as small as possible to avoid perturbation of the RF power propagating through the waveguide 36, while maintaining sufficient clearance to preclude the possibility of arcing due to the propagating RF power.

The operating band RF energy which propagates through the guidelets 54, plenum 76, and window 74 due to insertion loss terminate in the water load 78, causing the fluid within the water load to increase in temperature (see FIGS. 6 and 7). To remove the excess heat, and maintain the water load 78 at a near constant temperature, the leaky wall filter 30 comprises a cooling system within the housing 32 and water jacket 42. The housing 32 includes external coolant ports 96, 98 coupled to internal coolant channels 102 illustrated in FIG. 5. A coolant pipe 66 disposed at an opposite side of the housing 32 from the coolant ports 96, 98 links the internal coolant channels together. Similarly, as illustrated in FIG. 6, the water jacket 42 has external coolant ports 104, 108 which connect with a coolant chamber 78 provided opposite the window 74 from the plenum 76. Coolant port 104 can be connected to coolant port 98 by use of a coupler 62 to provide an uninterrupted flow path for a coolant fluid through the leaky wall filter 30.

Accordingly, a coolant fluid provided into coolant port 96 will pass through the internal channel 102 in the housing 32 to the pipe 66 that returns the fluid to the opposite internal channel to coolant port 98. The coolant fluid then flows through coupler 62 and coolant port 104 into chamber 78. Finally, the coolant fluid is exhausted through the external coolant port 108. As known in the art, microwave amplification systems utilize a coolant source containing a quantity of a coolant fluid. The coolant source can be coupled to the coolant ports 108 and 96 to ensure constant temperature performance of the leaky wall filter 30. A fluid having a high dielectric constant, such as water or a mixture of water and ethylene glycol, would be acceptable.

Having thus described a preferred embodiment of a leaky wall filter for use in suppression of the $2\pi$ mode oscillation frequencies in an extended interaction klystron, it should now be apparent to those skilled in the art that the aforestated objects and advantages for the within system have been achieved. It should also be appreciated by those skilled in the art that various modifications, adaptations, and alternative embodiments thereof may be made within the scope and spirit of the present invention.

For example, the leaky wall filter 30 is disclosed as being downstream from the window 22, and thus operates in a non-vacuum environment. It should be apparent that the leaky wall filter 30 would also operate in a vacuum environment as well. To operate in a vacuum environment, the housing 32 and water jacket 42 would have to be comprised of a high temperature, electrically conductive material, such as copper, to withstand the high temperature bake that the EIK is subjected to during construction. Moreover, the O-ring seals would likely be replaced with an alternative high temperature sealing material. Regardless, the selective placement of the leaky wall filter 30 in either of these environments would have no effect on the effectiveness of the filter.

The present invention is further defined by the following claims.

What is claimed is:

1. A leaky wall filter for use with an extended interaction klystron (EIK), comprising:

an output waveguide adapted to receive RF energy from said EIK;

a plurality of guidelets intersecting perpendicularly with a wall of said output waveguide, said guidelets capable of propagating $2\pi$ mode oscillation frequencies, produced by said EIK, out of said output waveguide;

means for suppressing said $2\pi$ mode oscillation frequencies comprising a plenum, a window, and a water load, said plenum being disposed at an end of said guidelets opposite to said output waveguide, said window being disposed between said plenum and said water load, and having a first surface facing said plenum and a second surface facing said water load, said window capable of coupling said $2\pi$ mode oscillation frequencies from said plenum into said water load;

wherein some RF energy adapted to be received from said EIK is capable of propagating into said guidelets due to insertion loss and is capable of being converted into thermal energy within said water load.

2. The leaky wall filter of claim 1, wherein said guidelets are spaced evenly over a distance equivalent to approximately half of a guide wavelength of said $2\pi$ mode oscillation frequency.

3. The leaky wall filter of claim 1, wherein said guidelets have a depth equivalent to at least half of a guide wavelength of said $2\pi$ mode oscillation frequencies.

4. The leaky wall filter of claim 1, wherein said window is comprised of alumina ceramic.

5. The leaky wall filter of claim 1, wherein said window has a groove disposed on at least one of said first and second surfaces which is capable of engaging an O-ring.

6. The leaky wall filter of claim 1, further comprising a jacket coupled to said water load capable of conducting a coolant fluid therethrough, said coolant fluid for removing said thermal energy from said water load.

* * * * *